United States Patent [19]

Schmidt

[11] 4,325,391

[45] Apr. 20, 1982

[54] INSTANTANEOUS SLURRY PREPARATION ON A CONTINUOUS BASIS

[75] Inventor: Otto K. Schmidt, South Windsor, Conn.

[73] Assignee: AMF Incorporated, White Plains, N.Y.

[21] Appl. No.: 179,408

[22] Filed: Aug. 18, 1980

Related U.S. Application Data

[63] Continuation-in-part of Ser. No. 1,248, Jan. 5, 1979, abandoned.

[51] Int. Cl.[3] ..... A24B 3/14

[52] U.S. Cl. ..... 131/372

[58] Field of Search ..... 131/17 AC, 17 AE, 140 R, 131/140 C, 133 R, 137

[56] References Cited

U.S. PATENT DOCUMENTS

| | | | |
|---|---|---|---|
| 2,887,414 | 5/1959 | Rosenburg et al. | 131/17 AC |
| 3,098,492 | 7/1963 | Wurzburg et al. | 131/17 AC X |
| 3,584,631 | 6/1971 | Halter et al. | 131/17 AC |
| 4,164,948 | 8/1979 | Beringer et al. | 131/140 C |

*Primary Examiner*—Stephen C. Pellegrino

*Attorney, Agent, or Firm*—George W. Price; Charles J. Worth

[57] ABSTRACT

The method and apparatus for combining a liquid baseweb and dry comminuted tobacco to produce a homogeneous mix of baseweb/tobacco which is shapable prior to the slurry being in its equilibrium state, and the shaped dried product resulting therefrom.

11 Claims, 5 Drawing Figures

INSTANTANEOUS SLURRY PREPARATION ON A CONTINUOUS BASIS

This application is a continuation-in-part of U.S. application, Ser. No. 001,248, filed Jan. 5, 1979, now abandoned, and generally relates to making sheet from comminuted tobacco and more particularly to the high speed preparation on a continuous basis of the slurry therefor.

Up to this time the conventional way to prepare a shapable tobacco-adhesive slurry has been to combine two essentially liquid phases; one being a tobacco dispersion and the other being a baseweb or an adhesive preparation with additives as may be required. Highly comminuted tobacco or tobacco powder does not wet very readily and is further retarded when it is added in a dry state to a liquid baseweb. To ensure homogeneity of the final slurry, the vessel of the mixer receiving the two liquid phases is sufficiently large to provide an extended residence time.

The extended time that the ground tobacco contacts the aqueous vehicle has various drawbacks. The extended time that the tobacco contacts the aqueous medium permits it to swell to its equilibrium state which increases the yield point of the slurry to be cast, subjects the tobacco to possible microbiological attack, and permits total extraction and interaction of the tobacco solubles which adversely affects the taste and burn characteristics of the tobacco sheet. Tobacco dispersions have to be maintained at continuous agitation to maintain homogeneity and this action in combination with the extended holding time, which is usually in excess of three hours can promote oxidative reactions therein which adversely affect the taste quality of a tobacco sheet produced therefrom.

Because of the time-dependened swelling characteristics and resultant yeildpoint of the slurry, more water needs to be incorporated in the slurry to permit casting or shaping, thus increasing the energy requirements of drying. In addition, the complexity of the equipment required for predispersion of the tobacco and for mixing of the tobacco dispersion and baseweb result in higher capital cost and large space and manpower requirements.

Accordingly, an object of the present invention is to provide means for rapidly preparing on a continuous basis, a shapable tobacco-adhesive slurry.

Another object of the present invention is to prepare the shapable slurry having a higher solids content than is available when preparing such a slurry by combining two or more liquid phases, resulting in lower energy requirements and higher production rates. Another objective of the present invention is to prepare a homogeneous tobacco-adhesive slurry to be shaped prior to the tobacco arriving at its equilibrium state.

Still another objective of the present invention is to provide a cost effective tobacco reconstitution manufacturing process characterized by low capital cost and reduced space and manpower requirements.

The foregoing and other objects and advantages will appear more fully hereinafter from a consideration of the detailed description which follows, taken together with the accompanying drawings wherein several embodiments of the invention are illustrated by way of example. It is to be expressly understood, however, that the drawings are for illustration purposes only and are not to be construed as defining the limits of the invention.

Figure 1:
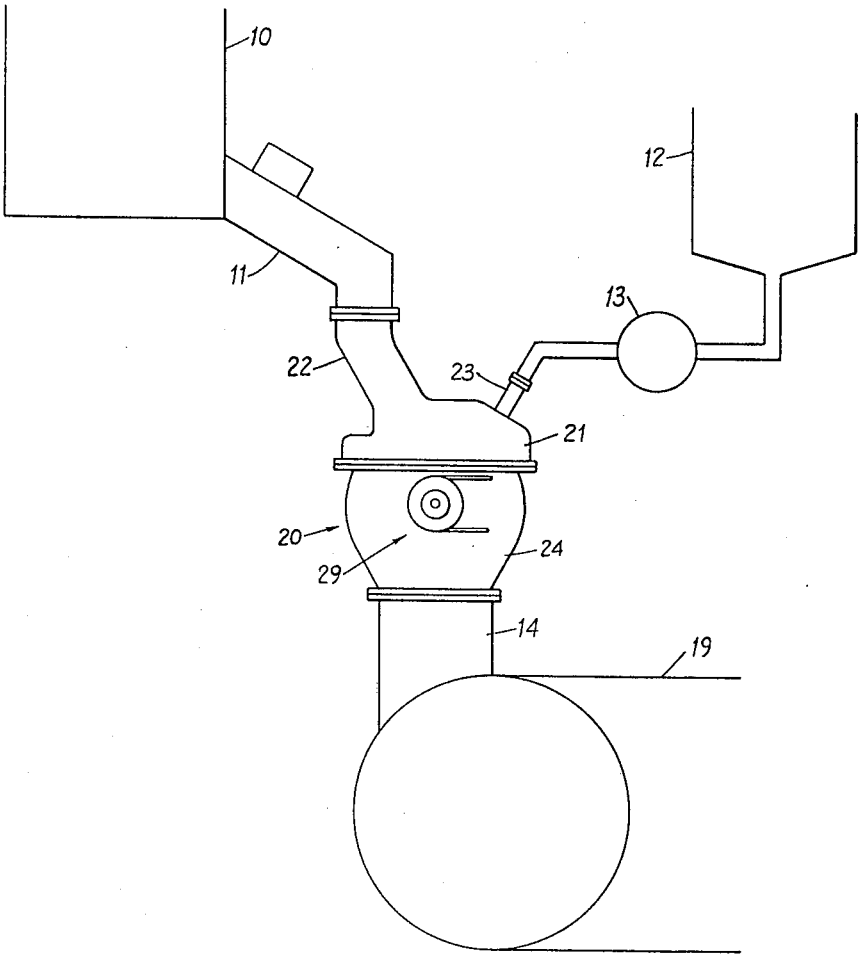
FIG. 1 is a diagrammatic illustration of apparatus for preparing a slurry in accordance with the present inventions.

Referring now to the drawings and particularly to FIG. 1, a hopper 10 for comminuted tobacco is provided with a vibration type feed mechanism 11 which is connected to a tobacco inlet 22 in the cover 21 of a high intensity mixing device 20 which will be further discussed. A reservoir 12 for the baseweb being an adhesive slurry with any additives desired is provided with pump means 13, which is connected to a second inlet 23 in the cover 21 of the high intensity mixing device 20.

The drive means for the feed mechanism 11 and the pump means 13 must be capable of being speed adjustable to permit proper proportioning of the tobacco and the baseweb being fed to the mixing means 20. Although not shown, the drives of the feed mechanism 11 and the pump means 13 may be provided with any suitable automatic flow sensing and control means well known in the art.

The high intensity mixing means 20 is provided with an adjustable variable speed drive as indicated at 29, which is conventional, and a main casing 24 with a bottom discharge 25 (see FIG. 3) which is connected to a slurry box 14 which provides or distributes a controlled layer of the final tobacco/baseweb slurry on to the casting belt 19.

Figure 2:
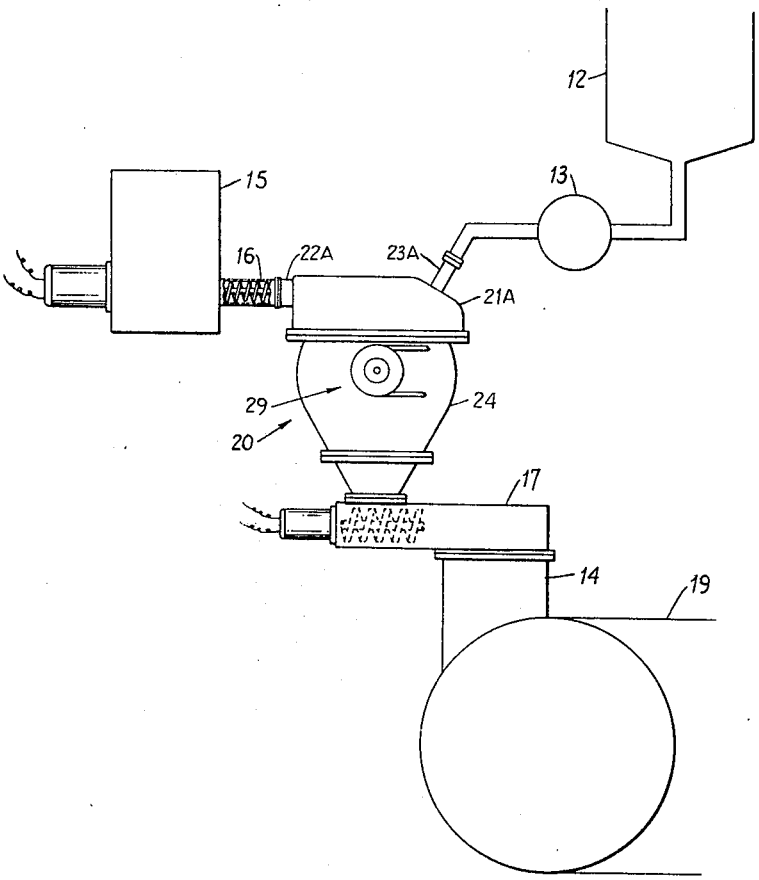
FIG. 2 is a diagrammatic illustration of apparatus which is a variation of the apparatus of FIG. 1.
Figure 4:
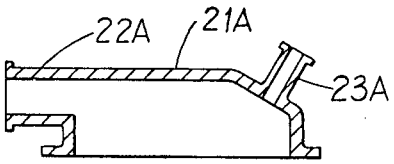
FIG. 4 is an enlarged sectional view of the cover of the slurry combining means of FIG. 2.

A variation of the apparatus of FIG. 1 is diagrammatically shown in FIG. 2. In place of the hopper 10 and the vibration type feed means 11, a modified hopper 15 is provided with a positive type feed 16 having a variable speed drive which is adjustable and may be provided with any suitable conventional flow sensing and control means. A modified high intensity mixing means 20A is substantially the mixing means 20 of FIG. 1 with a modified cover 21A (see also FIG. 4) having inlets 22A and 23A corresponding to inlets 22 and 23 of cover 21. The discharge end of the feed means 16 is connected to the inlet 22A and the pump 13 is connected to the inlet 23A.

As shown to assist in feeding the final slurry to be cast, a positive feed means 17 with an adjustable variable speed drive is interposed between the discharge 25 (see FIG. 3) of the modified high intensity mixer 20A and the slurry box 14. When a high solids slurry is prepared with limited flow characteristics which would appear questionable to properly deposited from the slurry box 14 on the casting belt 19, the slurry box 14 may be eliminated and the feed means 17 may be provided with an extrusion nozzle (not shown) to extrude the slurry on to the belt 19.

It should be fully understood that the modified hopper 15 with feed means 16 is totally independent from the discharge feed means 17. Each may be used in the absence of the other to modify the apparatus of FIG. 1.

Figure 3:
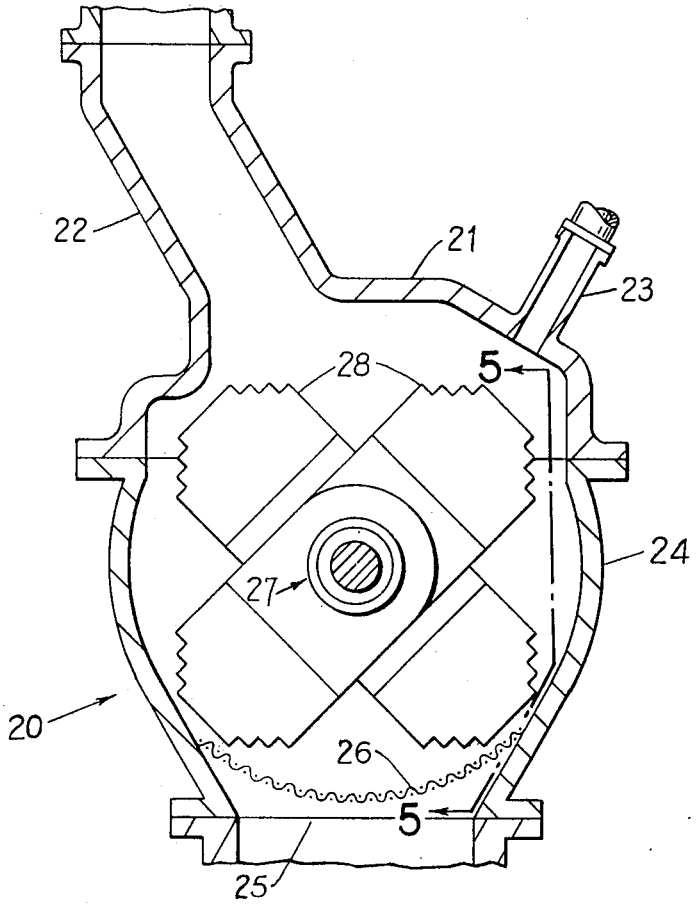
FIG. 3 is an enlarged sectional view of the slurry combining means of FIG. 1.
Figure 5:
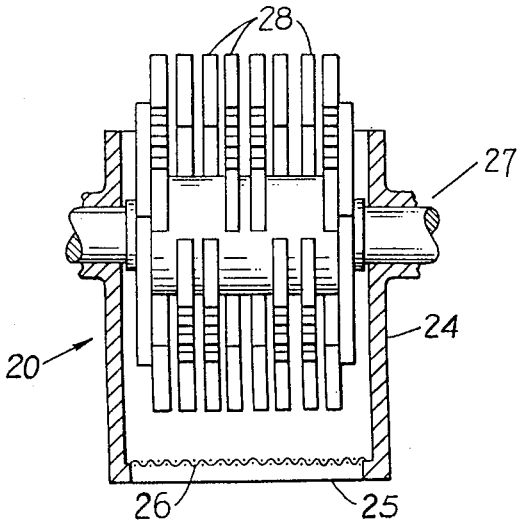
FIG. 5 is a sectional view taken on line 5—5 of FIG. 3.

A typical high intensity mixer 20 being essentially a grinding mill or comminuting machine is illustrated in FIGS. 3 and 5. A motor driven rotor 27, rotatable on an axis transverse to the axis of flow from inlets 22 and 23, or 22A and 23A, to the discharge 25, is provided with a plurality of series of blades 28 and is operated or rotated in a total free space which is kept within a reasonable minimum defined by the housing 24 and cover 21 or 21A of the mixer 20 or 20A. A screen 26 forms the lower portion of the actual chamber and extends across the bottom discharge 25, and is spaced closely to the ends of the blades 28 as the rotor is driven. Each series of blades 28 is so spaced, as may be seen by referring to FIG. 3, that all of the blades provide a wiping action across substantially the full width of the screen 26 during each revolution of the rotor 27 which with the centrifugal force induced by the high speed rotor contributes in expelling the slurry from the mixing chamber defined by the casing 24 and the cover 21 or 21A.

Inasmuch as the tobacco is preground and the baseweb is a slurry, the mill or the comminuting machine acts as a high intensity mixer. In the absence of the requirement to grind the introduced masses of comminuted tobacco and baseweb, the high speed rotor acting within the chamber provides a very high energy input acting on a relatively small total mass, causing substantially an instant homogeneous dispersion of the two heterogeneous masses into each other to form a homogeneous mass which is rapidly expelled by the wiping action and the centrifugal force of the high speed rotor. In this manner, the residence time of the slurry in the mixing device is kept to a minimum, and this slurry is rapidly fed through the slurry box 14 on to the casting belt 19.

It is known that the apparent viscosity of aqueous tobacco dispersion increases with time as the tobacco progressively absorbs the aqueous medium until the resulting slurry reaches its equilibrium state wherein the swelling tobacco has absorbed a maximum of the aqueous medium. It should be quite apparent that if the tobacco in the dry state and the baseweb slurry can be rapidly acted on to provide a homogeneous mix which can be cast prior to the tobacco slurry arriving at its equilibrium state, the tobacco slurry can contain a higher solids content with a viscosity which facilitates casting.

Preparation and casting a tobacco slurry in this manner is attended by various benefits. The short residence time in the high intensity mixer of limited amounts of slurry permits rapid start up, shut-down and cleanup and permits less extraction of the natural soluble ingredients of the tobacco which interact with one another and effect the taste of the resulting product. Also, microbiological attack of the tobacco caused by holding tobacco in a slurry form is prevented.

In a typical liquid-liquid system, the slurry composed of predetermined amounts of baseweb or adhesive slurry and tobacco dispersion normally will contain a solids content of from 8 to 11% and have a viscosity of 9 to 13,000 centipoises. Since aqueous tobacco dispersions are usually quite high in apparent viscosity, it is necessary to prepare such dispersions having a solids content within a range of 12 to 17% to maintain flow characteristics.

As an example, to prepare a tobacco/adhesive or baseweb slurry with 70% tobacco from a tobacco dispersion with 15.5% solids and a baseweb with 6.45% solids, the liquid phases will be combined at a ratio of 1.03 parts of baseweb to 1.00 part of tobacco dispersion and the resulting tobacco/baseweb slurry will have a 10.9% solids concentration. The mixing vessel is sized to provide a minimum residence time of over 10 minutes. However, to ensure homogeneity of the slurry, in practice the residence time is no less than 20 minutes.

In the conventional system the residence time of the tobacco-dispersion/baseweb slurry in the mixer is only of importance relative to achieving a uniform mix, since the tobacco is predispersed in water for some time before it comes in contact with the baseweb and thus is preswollen to its equilibrium state. Since the slurry has a high liquid content, drying of the slurry is relatively slow.

In accordance with the present invention, the tobacco contacts the aqueous medium only after it enters the high intensity mixer where it has a minimal residence time and is discharged for substantially immediate casting. Thus, the homogeneous tobacco/baseweb slurry is mixed and preferably cast prior to arriving at its equilibrium state. Thus, the solids content can be higher than the slurry in a liquid-liquid system and the reduced amount of liquid to be removed by the drier results in increased production rates.

It has been found by way of example that by utilizing the apparatus of FIG. 1 or 2, in accordance with the present invention, having a high intensity mixing means with a rotor driven at speeds of 3,500 to 5,000 RPM in a mixing chamber of about 138 cubic inches of free space or approximately 5 pounds of mass at any given instant, that the residence time of the slurry in the mixing chamber is proportional to the sheet production rate as demonstrated by the following data:

| | | | |
|---|---|---|---|
| Average Residence Time (Min.) | 0.154 | 0.13 | 0.10 |
| Dry Sheet Prod. Rate/Min. | 8.2 lbs. | 9.6 lbs. | 12.3 lbs. |
| Pounds of Slurry/Min. | 32.9 | 38.4 | 49.4 |
| % Solids | 22 | 22 | 22 |
| Pounds of Solids/Min. | 7.2 | 8.4 | 10.9 |

Since the limiting factor in such production rates is the designed efficiency of the dryer it follows that higher slurry solids permit increased sheet production rates at which instance the residence time of the slurry in the mixing chamber is further reduced. This is especially the case where slurry solids are worked which do not lend themselves readily to casting and where extrusion onto the drying belt constitutes the preferred sheet forming method.

Comparison of the foregoing data with the aforenoted data for a liquid-liquid system will be illustrative of the conceptual differences of the conventional liquid-liquid system and the present invention.

The term "tobacco" as used herein includes tobacco, reconstituted tobacco and tobacco waste such as stems or fines, tobacco substitutes such as cocoa leaves and other naturally occurring or cultivated vegetation, tobacco-like substances, and similarly structured synthetic compositions well known in the art e.g. cellulose or cellulose derivatives.

Although several embodiments of the invention have been illustrated and described in detail, it is to be expressly understood that the invention is not limited thereto.

Various changes may also be made in the design and arrangement of the parts without departing from the spirit and scope of the invention as will now be understood by those skilled in the art.

What is claimed is:

1. Apparatus for making a shapable tobacco/adhesive slurry having a high tobacco solids content, comprising means for continuously providing a predetermined amount of dry comminuted tobacco;

means for continuously providing a predetermined amount of aqueous adhesive proportional to the tobacco being provided; and high intensity mixing means having two inlets, one for receiving tobacco and the other for receiving adhesives;

said high intensity mixing means having a slurry discharge, said high intensity mixing means causing a substantially instantaneous homogeneous slurry of the tobacco and adhesive, and rapidly discharging the slurry before it arrives at its equilibrium state.

2. The apparatus in accordance with claim 1, and said means for providing aqueous adhesive comprising a tank for the aqueous adhesive, and;

pump means for feeding the aqueous adhesive at a predetermined rate from said tank to said mixing means.

3. The apparatus in accordance with claim 2, and said means for providing dry comminuted tobacco comprising a hopper for the tobacco, and means for feeding tobacco at a predetermined rate from said hopper to said mixing means.

4. The apparatus in accordance with claim 3, and said high intensity mixing comprising a housing cover providing said two inlets, a housing providing said slurry discharge and with said cover defining a mixing chamber, a screen disposed in said chamber across said slurry discharge, and a rotor disposed in said chamber being mounted on an axis transverse to the direction of flow from said inlets to said outlet, said rotor having a plurality of series of radially disposed blades, said series of blades being equally spaced arcuately around the axis of rotation of said rotor, and the blades of each series being selectively spaced so that the ends of all of said blades will provide a wiping action across the total surface of said screen and in close proximity thereto during each revolution of said rotor.

5. The apparatus in accordance with claim 4, and a slurry box positioned to receive slurry from said slurry discharge and adapted to apply a thin continuous layer of slurry on to an endless casting belt before the slurry arrives at its equilibrium state.

6. The apparatus in accordance with claim 5, and means for the positive feeding of the slurry from said slurry discharge to said slurry box.

7. The apparatus in accordance with claim 1, and said mixing means discharging the slurry before the residency time of the tobacco and adhesive exceeds one minute in said mixing means.

8. A method for making a shapable tobacco/adhesive slurry having a high tobacco solids content, comprising the steps of:

continually providing proportional amounts of dry comminuted tobacco and aqueous adhesive to high intensity mixing means;

rapidly mixing the tobacco and adhesive to substantially instantaneously produce a homogeneous slurry with a high tobacco solids content; and rapidly discharging the homogenous slurry from the mixing means before the slurry arrives at its equilibrium state.

9. The method in accordance with claim 8, and further comprising the step of depositing a continuous thin layer of discharged slurry on to an endless belt before the slurry arrives at its equilibrium state.

10. The method in accordance with claim 8, wherein the mixing time of the tobacco and adhesive does not exceed one minute.

11. A product made by shaping slurry made in accordance with the method of claim 8 into a film, filament or strand, and drying to a predetermined moisture content.

* * * * *